United States Patent [19]

Maruyama

[11] Patent Number: 4,536,141

[45] Date of Patent: Aug. 20, 1985

[54] ROTARY VANE COMPRESSOR WITH SUCTION PASSAGE CHANGING IN TWO STEPS

[75] Inventor: Teruo Maruyama, Hirakata, Japan

[73] Assignee: Matsushita Electric Industrial Co., Ltd., Kadoma, Japan

[21] Appl. No.: 554,293

[22] PCT Filed: Mar. 3, 1983

[86] PCT No.: PCT/JP83/00067

§ 371 Date: Nov. 1, 1983

§ 102(e) Date: Nov. 1, 1983

[87] PCT Pub. No.: WO83/03123

PCT Pub. Date: Sep. 15, 1983

[30] Foreign Application Priority Data

Mar. 4, 1982 [JP] Japan ..... 57-34823
Mar. 23, 1982 [JP] Japan ..... 57-46666

[51] Int. Cl.[3] ..... F04C 18/00; F04C 29/08
[52] U.S. Cl. ..... 418/150; 418/259
[58] Field of Search ..... 418/150, 259

[56] References Cited

U.S. PATENT DOCUMENTS 3,565,558 2/1971 Tobacman ..... 418/150

FOREIGN PATENT DOCUMENTS 55-151190 11/1980 Japan ..... 418/259
165176 10/1958 Sweden ..... 418/150

*Primary Examiner*—John J. Vrablik
*Attorney, Agent, or Firm*—Wenderoth, Lind & Ponack

[57] ABSTRACT

A rotary compressor which includes a rotor into which vanes are slidably provided, the rotor and vanes being rotatably mounted in a non-circular cylinder having side plates fixed to both sides thereof. The rotor, cylinder, and side plates define sealing spaces at respective ends of which are provided suction bores and discharge bores. Between the blades and also bounded by the rotor, side plates and cylinder are blade chambers which rotate with the rotor and vanes across the suction bores and discharge bores so that the pressure in the blade chambers during a suction stroke of the compressor utilizes a suction loss which is lower than the pressure of a refrigerant supply source to carry out suppression of the refrigerating capacity during high speed rotation of the rotor. The passages of communication from the suction bores to the blade chambers have effective areas which are smaller during the second half of each suction stroke than during the first half thereof, thereby obtaining an effective suppression of refrigerating capacity during high speed rotation of the rotor, while maintaining low torque at low speed and a high volumetric efficiency.

1 Claim, 25 Drawing Figures

ROTARY VANE COMPRESSOR WITH SUCTION PASSAGE CHANGING IN TWO STEPS

FIELD OF THE INVENTION

This invention relates to a rotary compressor for car air conditioning which has, for example, vanes and a wide ranging rotational speed.

BACKGROUND ART

Generally, a sliding vane type compressor, as shown in FIG. 1, comprises a cylinder 1 having therein a cylindrical space, side walls (not shown in FIG. 1) being fixed to both sides of the cylinder 1, and sealing blade chambers 2*a* and 2*b* being defined on opposite sides of the inner space in the cylinder 1, a rotor 3 disposed at the center thereof, vanes 5 being slidably engageable with grooves 4 provided in the rotor 3, suction bores 6*a* and 6*b* being formed in the cylinder 1, discharge bores 7*a* and 7*b* being formed in the same, communication conduits 8*a* and 8*b* communicating with the blade chambers 2*a* and 2*b* and the bore 6*a* and 6*b* being formed in the cylinder 1, and set screws 9*a* and 9*b* being provided at the suction side and those 10*a* and 10*b* being provided at the discharge side.

The vanes 5 project outwardly by a centrifugal force as the rotor 3 rotates, so that the outermost ends of vanes 5 slidably move along the inner periphery of cylinder 1, thereby prevent leakage of gas from the compressor.

FIG. 2 is a sectional side view of the compressor, in which reference numeral 11 designates a front plate reference numeral 12 designates a rear plate, reference numeral 13 designates a front casing, reference numeral 14 designates a rotary shaft, reference numeral 15 designates a shell, reference numeral 16 designates an annular suction conduit formed between the front casing 13 and the front plate 11, reference numeral 17 designates a suction piping joint, reference numeral 18 designates a suction conduit shown in broken line, reference 19 designates a disc for a clutch means, and reference numeral 20 designates a pulley for the clutch means.

The compressor, as shown in FIG. 1, having the cylinder 1 with an inner surface non-circular in section, requires a plurality of pairs of suction bores and discharge bores.

The inner surface of cylinder 1 being about elliptic in section, the compressor discharges a refrigerant compressed in the right-hand and left-hand blade chambers 2*a* and 2*b* through two discharge bores 7*a* and 7*b* into a common space 21 formed of cylinder 1 and shell 15.

Supply of the sucked refrigerant into two blade chambers 2*a* and 2*b* is separate from the discharge side and cut off therefrom by use of a construction shown in FIG. 2.

In detail, between the front plate 11 and the front casing 13 is formed the annular suction conduit 16 communicating in common with two suction bores 6*a* and 6*b* and the piping joint 17 provided at the front casing 13 connects the conduit 16 with an external refrigerant supply source (an exit of an evaporator).

Such a construction need only provide such one suction and piping joint even in a multilobe type compressor having two or more cylinder chambers.

Such a sliding vane type rotary compressor can be small-sized and simple in construction rather than the reciprocating compressor which is complex in construction and of many parts, thereby having recently been used for the car cooler compressor. The rotary compressor, however, has the following problems in comparison with the reciprocating compressor.

In a case of a car cooler (air conditioner), a driving force is transmitted from an engine to the pulley 20 at the clutch means through a belt to drive rotary shaft 14 of the compressor. Hence, when the sliding vane type compressor is used, its refrigerating capacity rises about linearly in proportion to the rate of rotation of the car engine.

On the other hand, in the case of using the reciprocating compressor, the follow-up property (response) of a suction valve becomes poor during high speed rotation and the compressed gas cannot be fully sucked into the cylinder. As a result, the refrigerating capacity leads to saturation during high speed driving. In brief, while the reciprocating compressor automatically suppresses the refrigerating capacity during the high speed driving, the rotary one does not do so and its efficiency deteriorates as the compression work increases, or is called upon to provide excessive cooling. In order to solve the above problem, the method has hitherto been proposed that a control valve for changing an opening area of communication be provided in the conduits communicating with the suction bores 6*a* and 6*b* at the rotary compressor, the opening area being restricted during the high speed rotation to utilize the suction loss for performing capacity control. In this case, however, an extra control valve must be attached, thereby creating the problem that the compressor is more complex in construction and expensive to produce. Another method, which uses a fluid clutch or planetary gears so as not to increase the rate of rotation above a predetermined value, has hitherto been proposed for eliminating the excessive capacity of compressor during the high speed driving.

However, the former method creates a greater energy loss caused by frictional heating between relatively moving surfaces, and the latter method requires the addition of a planetary gear mechanism of many parts so that the compressor is larger in size and configuration, thereby being difficult to put into practical use because the recent demand for energy saving increasingly requires simplification and miniaturization of the compressor.

After detailed research by the inventors of transient phenomena of pressure in the blade chamber in a case of using the rotary compressor for the purpose of solving the aforesaid problem created in accompaniment with the refrigeration cycle for a car cooler in a rotary system, it has been determined that even when the rotary compressor is used, if parameters for the suction bore area, discharge amount, and the number of vanes are properly selected and combined the self-suppression acts effectively on the refrigerating capacity during the high speed rotation as in the conventional reciprocating compressor, which has been proposed in the specification of Japanese Patent application No. Sho 55-134048.

Also, after study of the general characteristics of compressors in regard to power consumption as well as the volumetric efficiency, it has been found that if the effective suction area is allowed to vary in at least two stages and the effective areas in the first half and the second half in the suction stroke are properly set, then during low speed rotation the drive torque is expected to decrease, and moreover, during high speed rotation sufficient capacity control is obtained, which has been proposed in the specification of Japanese Patent application No. Sho 56-62875.

SUMMARY OF THE INVENTION

This invention has expanded application of the above to a general compressor. For example, in a concrete construction of a compressor in accordance with the invention, a non-circular cylinder subjected to capacity control is provided. An object of the invention is to provide a compressor having two laterally symmetrical chambers (two lobes) in a space formed by a rotor and an elliptic cylinder, providing at least four vanes disposed separately within the rotor, and forming the suction ports and suction grooves so that the effective suction area changes in about two stages during the suction stroke, thereby operating the compressor with low torque without lowering regrigerating capacity during the low speed driving and obtaining an effective suppression effect during high speed driving. The compressor of the invention comprises a rotor, vanes contained slidably therein, a non-circular cylinder containing therein the rotor, side plates fixed to both sides of the cylinder sealing spaces in blade chambers defined by the vanes, rotor and clyinder at both sides of the blade chamber, suction bores, and discharge bores, thereby utilizing a suction loss caused by pressure within the blade chamber lower than that of refrigerant supply source during the suction stroke so as to suppress the refrigerating capacity of the compressor during the high speed driving, and is characterized in that an effective area of each passage from the suction bore to the blade chamber is adapted to change in at least two stages to thereby be made smaller in the second half of the suction stroke than in the first half of the same.

DETAILED DESCRIPTION OF THE PREFERRED EMBODIMENTS

Next, the invention will be described in the following order:

(I) Basic construction of the invention (II) Principle of the same (III) Modified embodiment of the same (I) Explanation on the basic construction of the invention Next, explanation will be given of an embodiment of this invention for a two lobe-type (having an approximately elliptic cylinder) sliding vane compressor.

Figure 3:
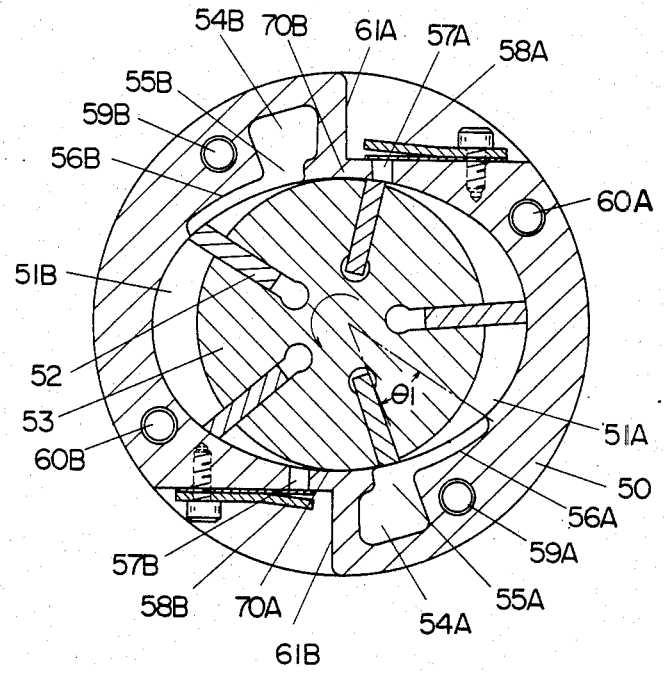
FIG. 3 is a sectional front view of an embodiment of a rotary compressor of the invention, FIG. 4-(*a*) is a view showing the positional relation between vanes and rotar of the compressor in FIG. 3 during the suction stroke, FIG. 4-(*b*) is a view showing the positions of the vanes and rotor of a the same just before a termination of the suction stroke, FIG. 4-(*c*) is a view showing the positional relation between the respective vanes and the rotor at the termination of suction stroke.

FIG. 3 is a sectional front view of an embodiment of a compressor of the invention, in which reference numeral 50 designates a cylinder, reference numeral 51A designates a blade chamber A, reference numeral 51B designates a blade chamber B, reference numeral 52 designates vanes disposed in a rotor 53 spaced circumferentially thereof at five equal intervals, reference numeral 54A and 54B designate suction bores (ports), reference numerals 55A and 55B designate suction nozzles, reference numerals 56A and 56B designate suction grooves formed at the inner periphery of cylinder 50, reference numerals 57A and 57B designate discharge bores, reference numerals 58A and 58B designate discharge valve holders, reference numerals 59A and 59B designate fixing bolts at the suction side, reference numerals 60A and 60B designate fixing bolts at the discharge side, and reference numerals 61A and 61B designate cutouts formed at the positions where the suction side and discharge side are laterally separated from each other.

Now, the embodiment of the compressor of the invention in FIG. 3 is different largely from the conventional compressor (in FIG. 1) in the following points:

(i) The compressor in FIG. 3 has suction bores 54A and 54B in proximity to the top portions 70A and 70B of cylinder 1.

Figure 2:
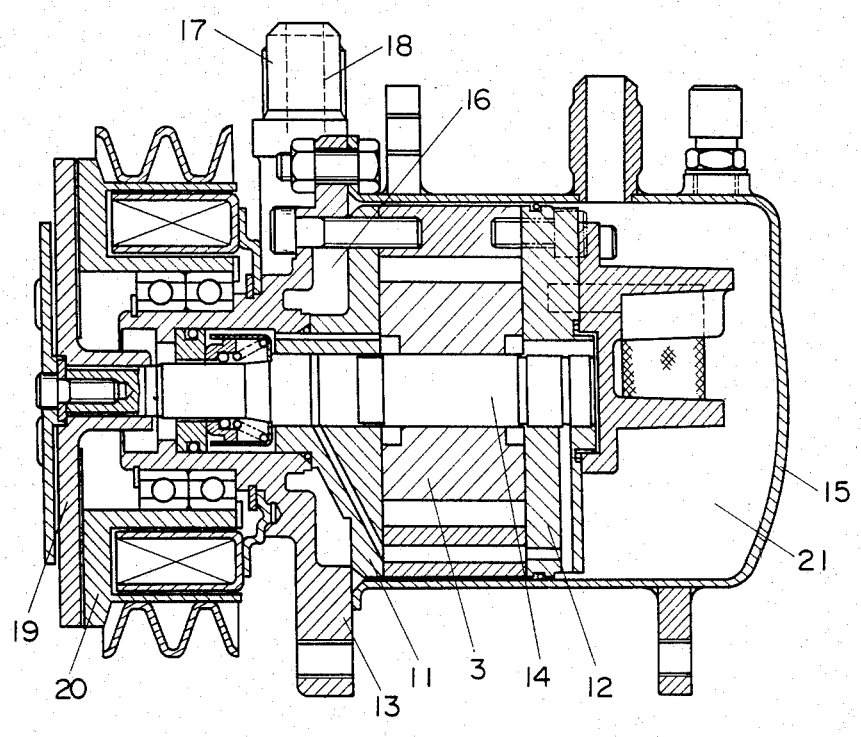
FIG.2 PRIOR ART
FIG. 2 is a side view of the compressor in FIG. 1.

(ii) The fixing bolts 59A and 59B for fixing the cylinder 50 with the front plate and rear plate (not shown but in FIG. 2) are disposed ahead of suction bores 54A and 54B in the rotating direction of rotor 50.

(iii) At the inner surface of cylinder 50 are provided suction grooves 56A and 56B across an angle of $\theta_1$ (measured from the respective centers of suction bores 54A and 54B to the ends of suction grooves 56A and 56B).

A sliding vane compressor comprising a cylinder other than the round one is to be hereinafter called the multilobe type compressor.

TABLE 1

| Parameter | Reference | Number of vanes 3 | 4 | 5 | Round cylinder with two vanes for reference |
|---|---|---|---|---|---|
| Rotary angle of vane end at termination of suction | $\theta_s$ | 150° | 135° | 126° | 270° |
| Travelling angle of cylinder groove (control zone) | $\theta_1$ | 8.6° | 23.4° | 32.6° | 70° |
| Ratio of $\theta_1$ to $\theta_s$ | $\theta/\theta_s$ | 0.057 | 0.1730 | 0.259 | 0.259 |

Figure 4A:
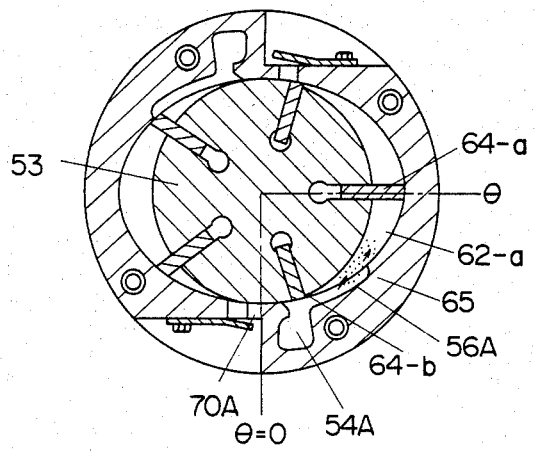
Figure 4B:
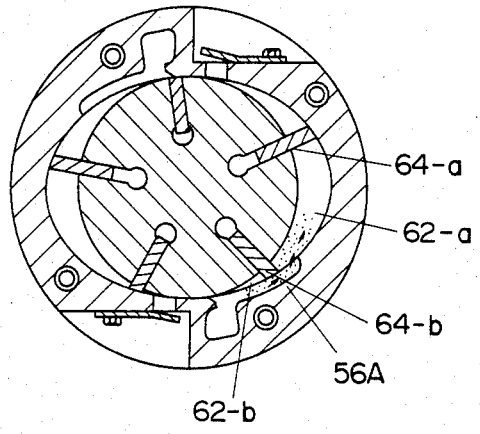
Figure 4C:
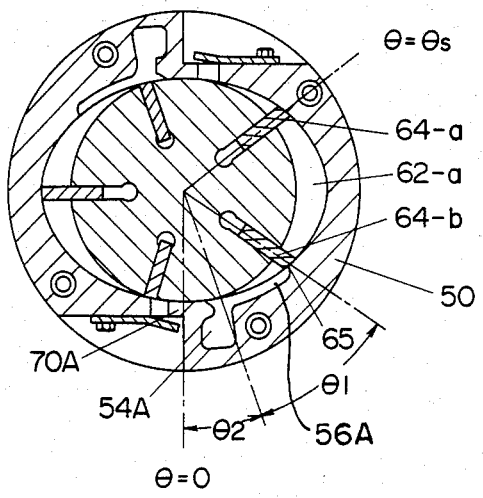

In the above Table 1, $\theta_s$ designates the rotary angle of the vane end of the downstream vane at the termination of suction, $\theta_1$ designates the travelling angle of the cylinder groove, that is, the angles about the cylinder center subtended by suction grooves 56A and 56B and $\theta_2$ designates the port position angle. These angles are further defined as follows:

In FIGS. 4*a*, 4*b*, and 4*c* reference numeral 62*a* designates a blade chamber at the down-stream side, reference numeral 60*b* designates a blade chamber at the upstream side, reference numeral 70A designates a top portion of cylinder 50, reference numeral 64*a* designates a vane a, reference numeral 64*b* designates a vane b, and reference numeral 65 designates an end of suction groove 56A.

The position where the vane end passes along the top portion 70A around the axis of rotation of rotor 53, is represented by $\theta=0$, that is, at the top of the minor axis of the elliptical cross section of the inner surface of the cylinder, where the suction bore is separated from the discharge bore, in which $\theta=0$ is made the origin and an arbitrary angular position of vane end is represented by $\theta$. When the downstream side blade chamber 62*a* is viewed, FIG. 4-(*a*) shows the vane 64*a* having already passed the suction bore 54A and suction groove 56A and positioned at an angle of about $\theta=90°$, a refrigerant being supplied from the suction bores 54A directly to the downstream side blade chamber 62*a* as shown by the arrow.

FIG. 4-(*b*) shows a condition just before the termination of a suction stroke, in which the refrigerant is supplied to the downstream side blade chamber 62*a* from between the vane 64*b* and the suction groove 56A.

FIG. 4-(*c*) shows a condition of termination of the suction stroke of downstream side blade chamber 62*a* (where $\theta=\theta_s$), in which the radially outer end of vane 64*b* is positioned at the suction groove end 65. At this time, the downstream side blade chamber 62*a* bounded by the vanes 64*a* and 64*b* is maximum in volume.

The port position angle $\theta_2$ represents an angle between the top portion 70A at the cylinder 50 and the center of suction port 54A, the travelling angle $\theta_1$ of the cylinder groove in the control zone representing the angle of travelling of vane 64*b* along the suction groove 56A until the suction stroke terminates.

In the embodiment, the centers of the suction ports 54A and 54B are positioned at an angle of $\theta_1=21.4°$.

The closer the suction port is positioned to the top portion (where $\theta=0$), the smaller a gap between the rotor 53 and the cylinder 50 becomes, whereby the effective suction area is difficult to enlarge. Hence, it is necessary for the travelling angle $\theta$ to be in the range 20° to 30° or more in general to form the suction port apart from the top portion 70A.

Figure 5:
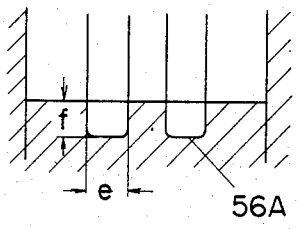
FIG. 5 is a sectional view of a suction groove.

FIG. 5 is a sectional view of suction groove 56A formed at the cylinder 50, in which the effective area of the suction groove is of a product $s=e\times f$ of suction groove 56A, multiplied by the coefficient of contraction.

Now, in the embodiment of the invention, the multilobe type compressor is used to step change the effective suction area during the suction stroke, thereby enabling realization of a compressor which is operable at low speed, has reduced volumetric efficiency loss, saves power consumption, and effectively suppresses the refrigerating capacity during high speed driving only.

The multi-lobe type compressor is smaller in total weight of refrigerant allotted to one blade chamber in comparison with the compressor having a round cylinder, thereby being advantageous in its high speed durability with respect to fluid compression or excess compression. It will be detailed in Item (II) below the stepped change of suction area makes effective the capacity control characteristic, but first the compressor of multi-lobe type having three vanes and four vanes will be compared with that of the aforesaid five vanes in the following description.

Figure 6:
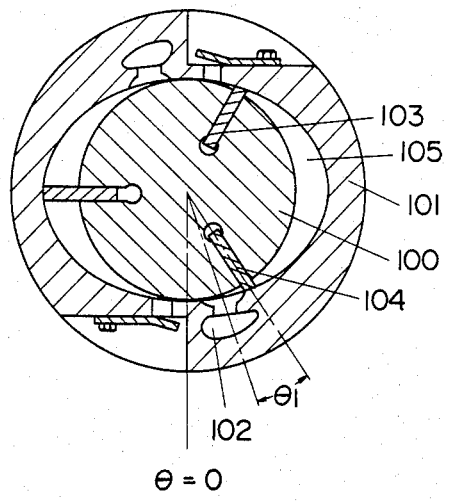
FIG. 6 is a sectional front view of a compressor with three vanes, FIG. 7-(*a*) is a sectional front view of a compressor with four vanes working during the suction stroke, FIG. 7-(*b*) is a view showing the positions of the vanes and rotor of the four vane rotary compressor at a termination of the suction stroke, .

FIG. 6 shows a construction of the three vane compressor, in which reference numeral 100 designates a rotor, reference numeral 101 designates a cylinder, reference numeral 102 designates a suction port, reference numeral 103 designates a vane a, reference numeral 104 designates a vane b, and reference numeral 105 designates a blade chamber A. A travelling angle $\theta_1$ of vane b 104 following the vane a 103 is only 8.6° with respect to the cylinder groove, thereby being difficult to construct with an effective suction area in a stepped manner during the suction stroke.

Figure 7A:
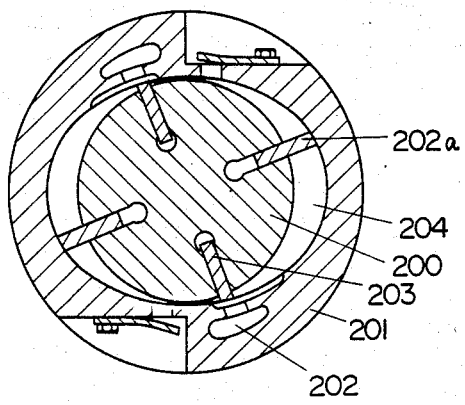
Figure 7B:
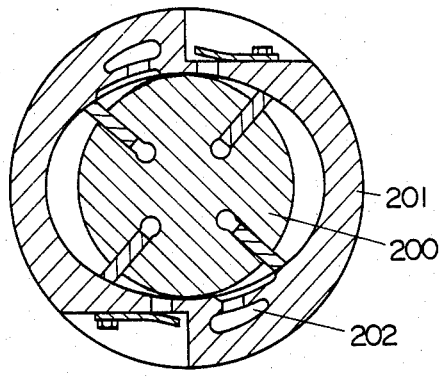

FIG. 7 shows a construction of the four vane compressor, in which reference numeral 200 designates a rotor, reference numeral 201 designates a cylinder, reference numeral 202 designates a suction port, reference numeral 202*a* designates a vane a, reference numeral 203 designates a vane b, and reference numeral 204 designates a blade chamber A.

In this case, the above travelling angle is $\theta_1=23.4°$ and $\theta_1/\theta_s=0.173$, which is slightly disadvantageous in the stepped construction in comparison with the five vane compressor of $\theta_1/\theta_s=0.259$ or the two vane compressor having a round cylinder (wherein $\theta_2=20°$).

Figure 8:
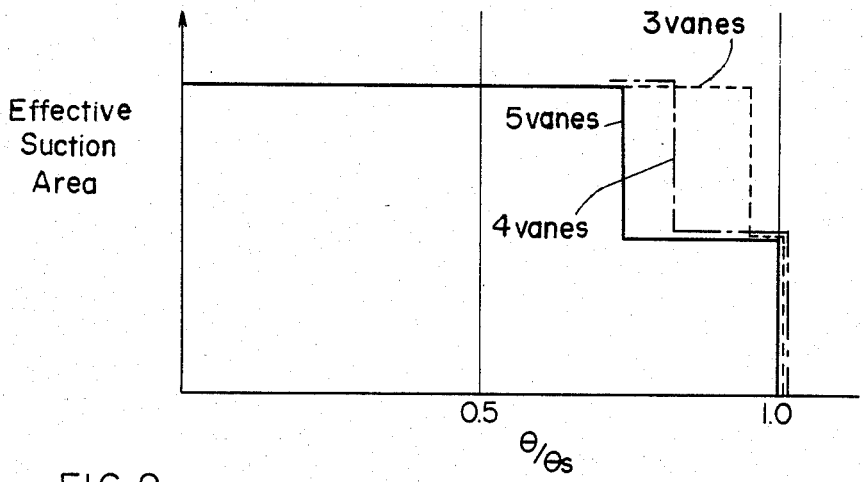
FIG. 8 is a graph showing a pattern of the number of vanes and effective suction area.

FIG. 8 shows a pattern of effective suction area obtainable by the respective compressors different in numbers of vanes. In a case of applying the capacity control to the multi-lobe type compressor, it is seen from the above that the number of vanes should be properly selected for reducing torque and improving the Cop (control processor), especially in the low speed zone.

Figure 1:
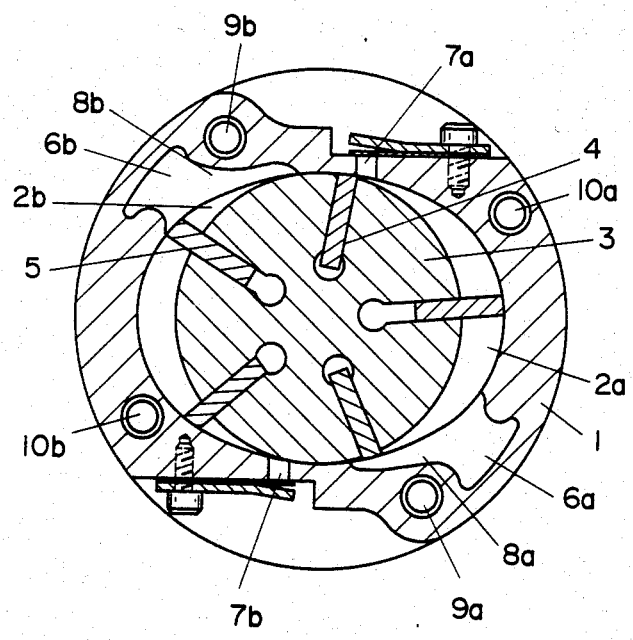
FIG. 1 PRIOR ART
FIG. 1 is a sectional front view of a conventional sliding vane type rotary compressor.

The embodiment of FIG. 3, in comparison with the conventional construction of FIG. 1, enabled the travelling angle $\theta_1$ of the cylinder groove to be enlarged sufficiently from a design of arrangement of suction bores 54A and 54B and suction grooves 56A and 56B as described in the aforesaid items (i) to (iii).

Figure 9:
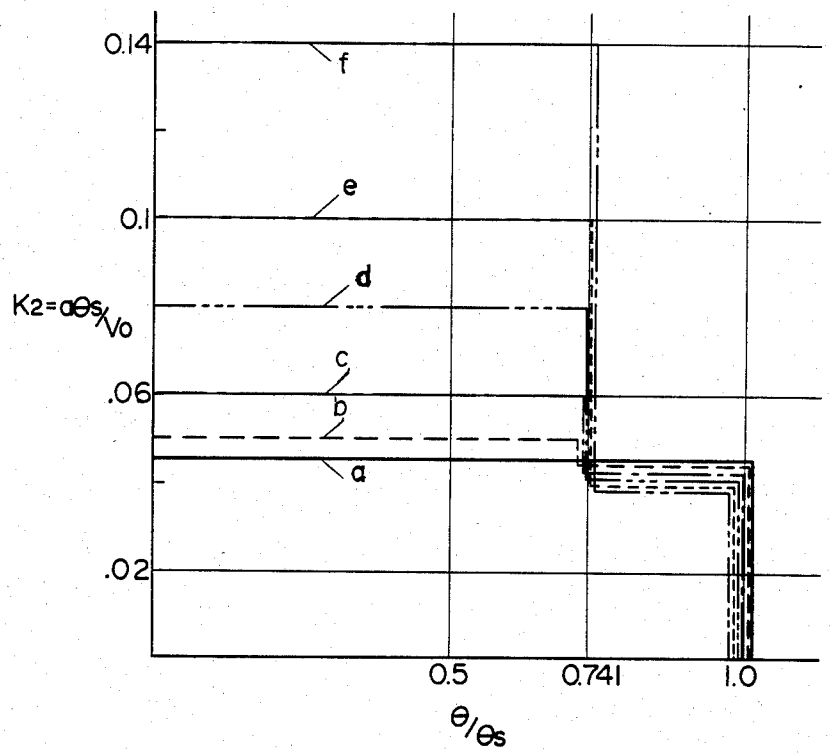
FIG. 9 is a graph showing the relation between the effective suction area and the travelling angle of each vane.

In the conventional construction in FIG. 1, it is difficult to set the effective suction area in the patterns (b) to (f) as shown in FIG. 9.

(II) Explanation of Principle of the Invention

Next, it will be explained, together with the result of an analysis of characteristics in the suction stroke, why the stepped change of effective suction area during the suction stroke is effective.

FIG. 9 and Table 2, show in the patterns (a) to (f) the effective suction area a with respect to the vane travelling angle, where the effective suction area has been indicated by the capacity control parameter $K_2$ in order to provide a relative comparison of characteristics of various compressors ($K_2$ is to be discussed below).

TABLE 2

| Pattern | Effective area arranged by $K_2 = a^{\theta}s/V_o$ First half: $K_{21} = a_1\theta_s/V_o$ | Second half: $K_{22} = a_2\theta_s/V_o$ |
|---|---|---|
| (a) | 0.0451 | |
| (b) | 0.050 | 0.0436 |
| (c) | 0.060 | 0.0421 |
| (d) | 0.080 | 0.0411 |
| (e) | 0.100 | 0.0391 |
| (f) | 0.140 | 0.0386 |

In the pattern (a), the effective suction area a is always constant during the suction stroke, which is realized by constructing the compressor to make larger the sectional area, $S=2\times e\times f$, of suction groove 56A with respect to an area of suction bore 54A (see FIG. 5).

The patterns (b) to (f) shows the effective suction area made larger in the first half of suction stroke and smaller in the second half of the same. Especially, the patterns (b) to (f) correspond to the present invention aiming at reducing torque during low speed driving.

In the embodiment, reversely to the pattern (a), the effective areas of suction grooves 56A and 56B were made smaller than those of suction bores 54A and 54B.

Next, an explanation will be given of the characteristic analysis carried out to define in detail the transient phenomenon of refrigerant pressure, which is an important point for the invention.

The transient characteristic of pressure in the blade chamber is given by the following energy equation:

$$\frac{Cp}{A}GT_A - Pa\frac{dVa}{dt} + \frac{dQ}{dt} = \frac{d}{dt}\left(\frac{C_V}{A}\gamma aVaTa\right), \quad (1)$$

where G is the mass flow of refrigerant, Va is the blade chamber volume, A is the thermal equivalent of work, Cp is the specific heat at constant pressure, $T_A$ is the refrigerant temperature at the supply side, K is the ratio of specific heat, R is the gas constant, CV is the specific heat in constant volume, Pa is the pressure in blade chamber, Q is the quantity of heat, Ya is the specific weight of refrigerant in the blade chamber, and Ta is the refrigerant temperature in the blade chamber. In addition, in the following equations (2) to (4), a is the effective area of the suction bore, g is the gravitational acceleration, YA is the specific weight of refrigerant at the supply side, and Ps is the refrigerant pressure at the supply side.

In the equation (1), the first term on the left side represents the thermal energy of refrigerant taken into the blade chamber through the suction bore per unit time, the second term on the left side represents the work of refrigerant pressure with respect to the exterior per unit time, the third term on the left side represents thermal energy flowing into the blade chamber from the exterior through the outer wall, and the right side represents an increment in the internal energy of the system per unit time. Assuming that the refrigerant conforms with the rule of ideal gas and the suction stroke is rapid so as to cause adiabatic change, from $\gamma a = Pa/RTa$ and $(dQ/dt)=0$, the following equation is given:

$$G = \frac{dVa}{dt}\left(\frac{A}{CpT_A} + \frac{1}{kRT_A}\right)Pa + \frac{Va}{kRT_A}\cdot\frac{dPa}{dt} \quad (2)$$

Also, by use of the relational expression $(1/R)=(A/Cp)\times(1/kR)$, $$G = \frac{1}{RT_A}\cdot\frac{dVa}{dt}\cdot Pa + \frac{Va}{kRT_A}\frac{dPa}{dt} \quad (3)$$

is obtained.

The theory of nozzles applies to a mass flow of refrigerant passing through the suction bore, whereby the equation:

$$G = a\sqrt{2g\gamma_A Ps\frac{1}{k-1}\left[\left(\frac{Pa}{Ps}\right)^{\frac{2}{k}} - \left(\frac{Pa}{Ps}\right)^{\frac{k+1}{k}}\right]} \quad (4)$$

is obtained. Therefore, by solving the equations (3) and (4), the transient characteristic of pressure Pa in the blade chamber is obtained.

Figure 10:
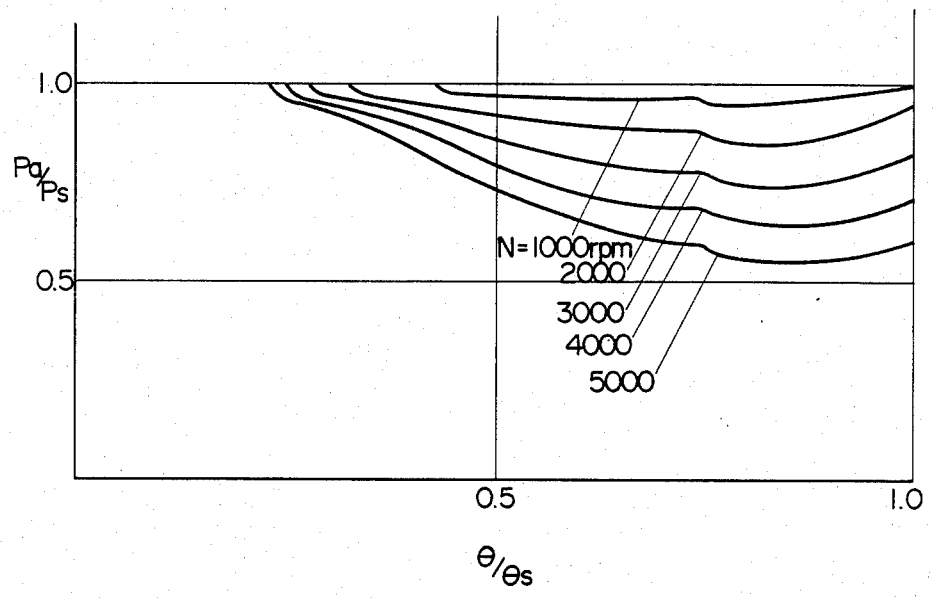
FIGS. 10, 11 and 12 are graphs showing the relationship between the pressure in a blade chamber and the travelling angle of the respective vanes.

FIG. 10 shows the transient characteristics of pressure in the blade chamber in a case of the effective suction area (c) in FIG. 9 with the rate of rotation as a parameter, determined by solving the equations (3) to (4) for five vanes in Table 1, the conditions listed in Table 3, and the initial conditions t=0 and Pa=Ps. Since the refrigerant in the refrigerating cycle for the car cooler usually uses R12 (dichlorodifloromethane), the analysis was carried out by using k=1.13, $\gamma_A=16.8\times10^{-6}$kg/cm$^2$ and $T_A=28.3°$ K.

In FIG. 10, the pressure in the blade chamber Pa during the low speed rotation ($\omega=1000$ rpm) and in the vicinity of $\theta/\theta_s=1(\theta=\theta_s=126°)$ at the termination of the suction stroke reaches supply pressure Ps=3.18 kg/cm$^2$ abs., thereby creating no loss in the pressure in the blade chamber at the termination of the suction stroke. Upon increasing the rate of rotation, the refrigerant supply cannot keep up with the volume change of the blade chamber so that the pressure loss at the termination of the suction stroke ($\theta/\theta_s=1$) increases. For example, when N=5000 rpm the pressure loss $\Delta P=1.30$kg/cm$^2$(Pa/Ps=0.591) is created with respect to the supply pressure Ps to cause a decrease in the gross weight of sucked refrigerant and lead to a large reduction of refrigerating capacity.

TABLE 3

| Parameters | Reference | Embodiments |
|---|---|---|
| Refrigerant pressure at supply side | Ps | 3.18 kg/cm$^2$ abs |
| Refrigerant temperature at supply side | $T_A$ | 283° K. |
| Refrigerant pressure at discharge side | Pd | 15.51 kg/cm$^2$ abs |

TABLE 3-continued

| Parameters | Reference | Embodiments |
|---|---|---|
| Rate of rotation | N | 600–5000 rpm |

Figure 11:
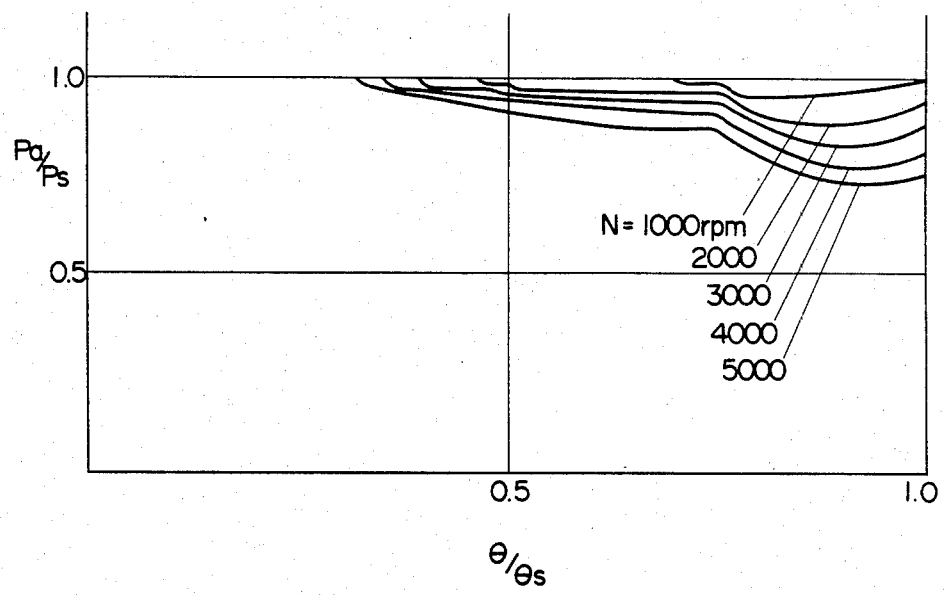
Figure 12:
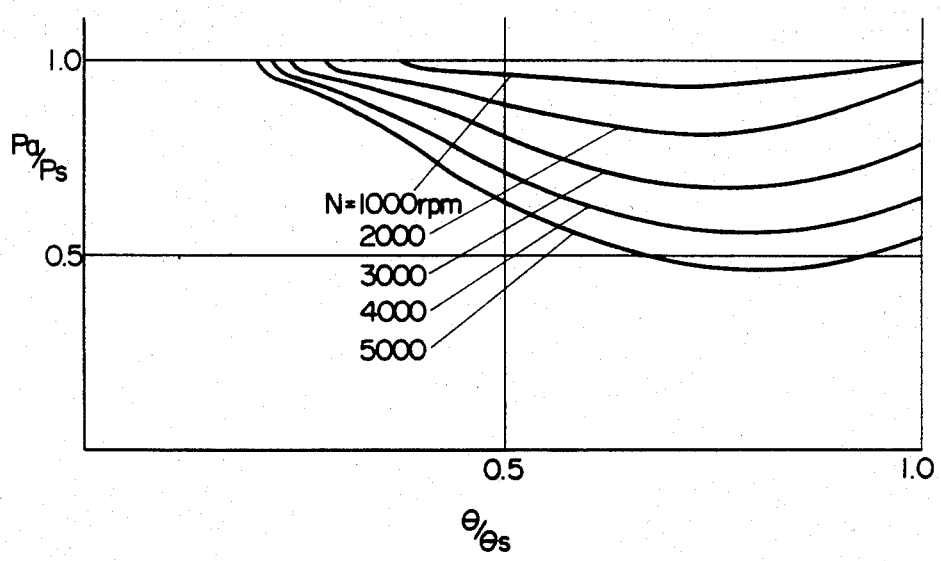

The effective suction areas (f) and (a) in FIG. 9 are shown in FIGS. 11 and 12, respectively.

Now, when the pressure in the blade chamber at the termination of the suction stroke is represented by Pa=-Pas, the pressure drop rate np (drop each stroke) is defined as follows:

$$\eta p = \left(1 - \frac{Pas}{Ps}\right) \times 100 \quad (5)$$

Figure 13:
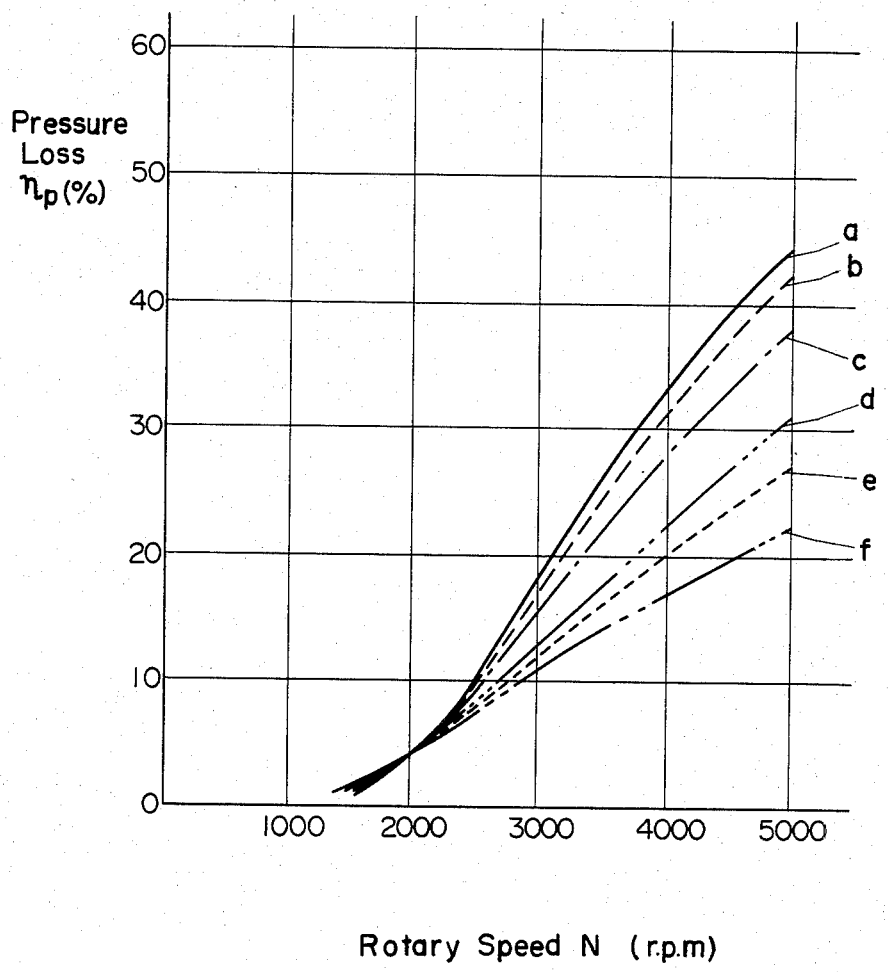
FIG. 13 is a graph showing the rate of pressure drop as a fuction of the rate of rotations of the rotor.

FIG. 13 is a graph showing a characteristic of the pressure drop rate with respect to the rate of rotation when the effective suction areas (a)–(f) of FIG. 9 are different. Namely, 1. During low speed rotation of N=2000 rpm, the compressors having the effective suction areas of (a) to (f) in FIG. 13 are about identical in pressure drop rate.

2. During high speed rotation of N=5000 rpm, the compressor of (a) whose effective suction area is constant during the suction stroke, provides the maximum pressure drop rate.

3. The embodiment in Table 1 of effective suction area for 5 vanes in FIG. 13-(*c*), has the characteristic corresponding about to the above (c) in FIG. 12, the compressor of the same in (f) having a considerably smaller np of the effect of capacity control.

The pressure drop rate may be considered to be about equal to the drop in gross weight of refrigerant in the blade chamber, at the termination of the suction stroke. Accordingly, the compressor having the pressure drop rate characteristic (c) with respect to the rate of rotation shown in FIG. 13, even when with respect to only the control amount of refrigerant, is known to obtain a refrigerating capacity nearly conforming to the ideal one as follows:

(i.) During low speed rotation, the suction loss lowers the refrigerating capacity a little.

The reciprocating compressor having self suppression of the refrigerating capacity during high speed rotation, is characterized in that its suction loss is minimum at low speed rotation, but the rotary compressor of the invention is not inferior to the reciprocating one at low speed rotation.

(ii.) During the high speed rotation, the rotary compressor of the invention obtains the refrigerating capacity suppression equal to or more than that the conventional reciprocating compressor.

(iii.) In a case of raising the rate of rotation to more than 1800–2000 rpm, the suppression effect is obtained so that, when used as the compressor for a car cooler, a refrigerating cycle of ideal energy saving and providing good temperature control is obtained.

(iv.) The drive torque lowers about in proportion to the rate of rotation, thereby obtaining the effect of large energy saving during the low and high speed rotations.

The effects described in Items i to iii above have already been disclosed in the Japanese Patent Application No. Sho 55-134048.

The embodiment of the present invention is characterized, besides the above effects in Items i to iii, in that the multi-lobe type compressor of non-circular cylinder, even when used, can obtain lower power consumption at the low speed rotation.

Now, in a case of applying the capacity control, the drive torque of the compressor includes the following characteristics:

1. A loss in the suction stroke.
2. Compression power at the compression stroke.
3. A loss by excessive compression pressure.

The above characteristics 1 to 3 will be explained with reference to FIGS. 14 and 15 of for the preferred embodiment of the invention.

Figure 14:
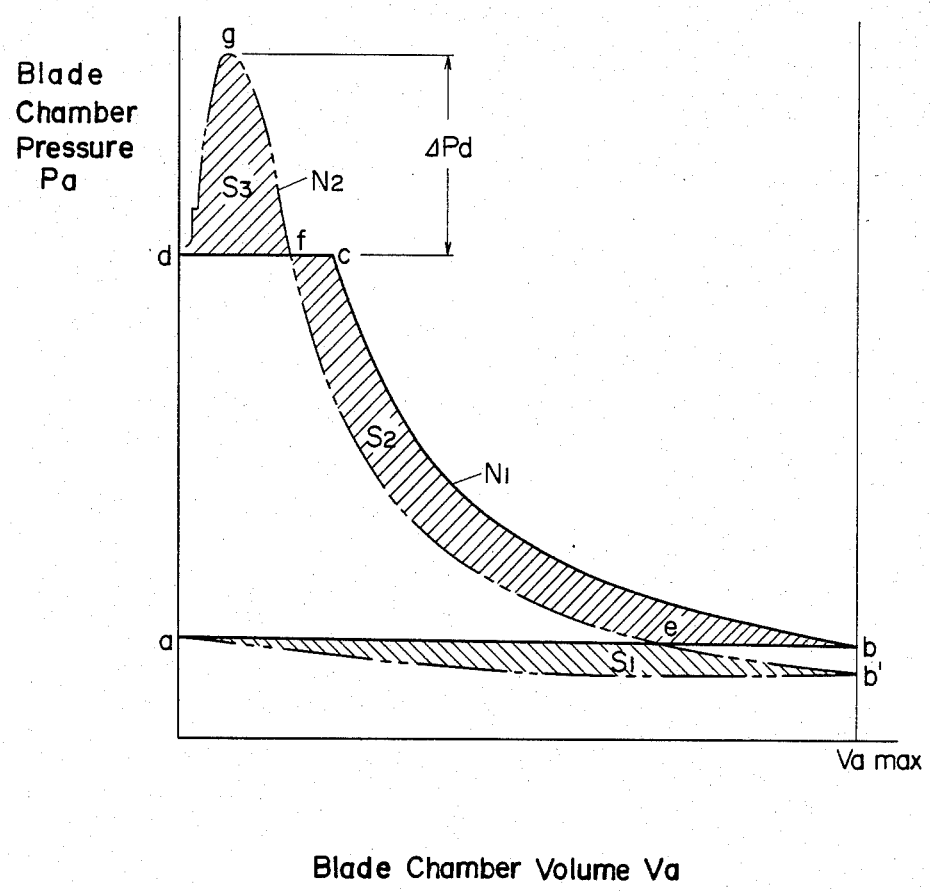
FIG. 14 is a model diagram of pressure-volume curves.

In FIG. 14, a curve $N_1$ described by characteristic points a, b, c and d shows a standard polytropic suction compression stroke. Also, a curve $N_2$ described by characteristic points a, b', e, f, g and d illustrate the effects of the capacity control, the curves $N_1$ and $N_2$ showing the effective suction area constant during the suction stroke, for example, the PV chart of effective area (a) in FIG. 9. In a case of applying the capacity control, the pressure Pa in the blade chamber at the beginning point of the compression stroke lowers as the rate of rotation increases. In a case of not applying the capacity control, since the refrigerant is filled completely into the blade chamber, the pressure Pa in the blade chamber at the compression stroke starting point b, i.e., Va=Va max. (or the suction stroke termination) is constant regardless of the rate of rotation.

Figure 15:
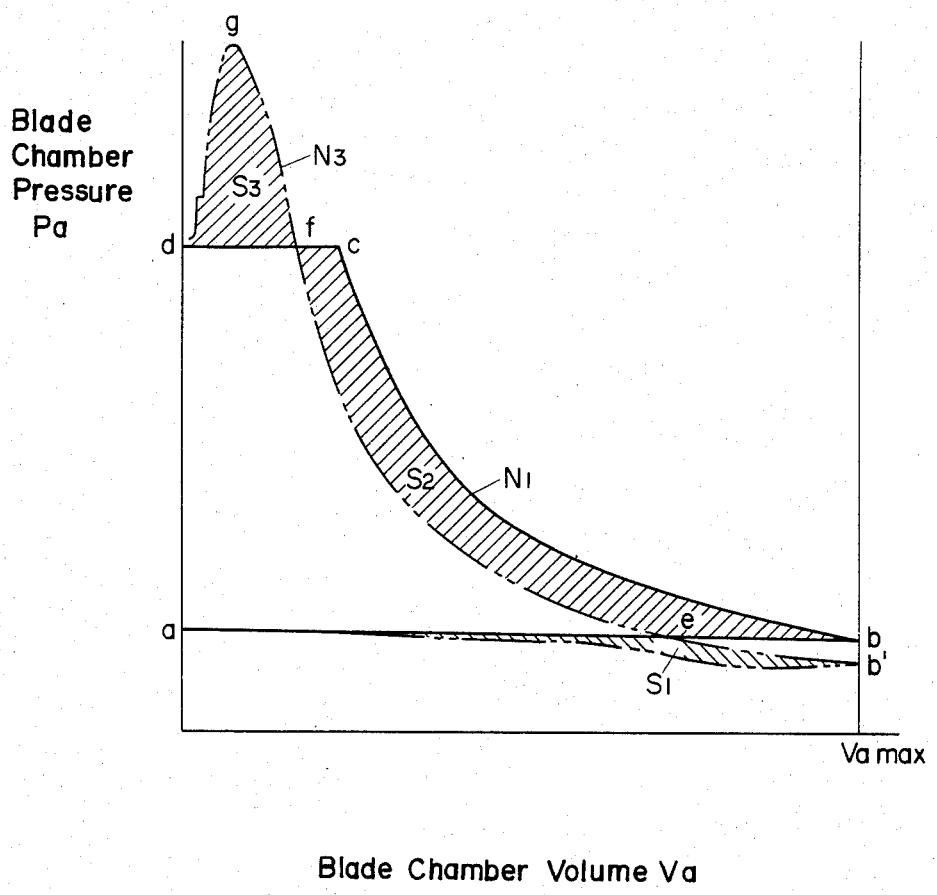
FIG. 15 is a model diagram of PV curves in the embodiment of the invention.

Referring to FIG. 15, a curve $N_3$ corresponds to the PV chart for areas (b)–(f) in FIG. 9 where the effective suction area is two-stepped, in which an area $S_1$ in FIG. 15 represents power loss in the suction stroke, that an area $S_2$ represents decrement of compression power by the capacity control effect, and that an area $S_3$ represents loss of excessive compression power.

Figure 16:
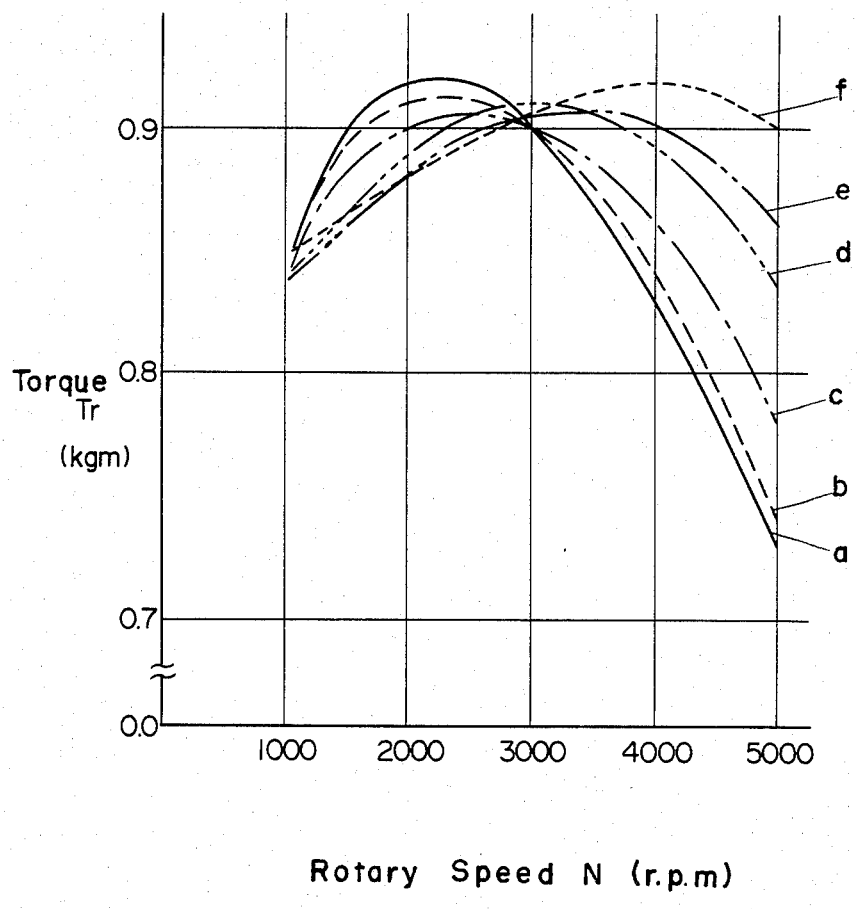
FIG. 16 is a graph showing torque as a function of the rate of rotation of the rotor.

In a case where the effective suction area is constant in the suction stroke (area (a) in FIG. 9), since the pressure Pa in the blade chamber starts to lower when the volume Va of the blade chamber is still small, its suction power loss $S_1$ (in FIG. 14) is larger. On the other hand, in a case where the effective suction area is larger in the first half of the suction stroke and smaller in the second half of the same (for example, area (c) in FIG. 9), since a drop of pressure Pa in the blade chamber is smaller in the first half, the suction loss $S_1$ (in FIG. 15) as a whole becomes smaller in comparison with the former case. FIG. 16 shows an examplary characteristic drive torque with respect to the rate of rotation for each of the patterns of effective suction areas (a)–(f).

Figure 17:
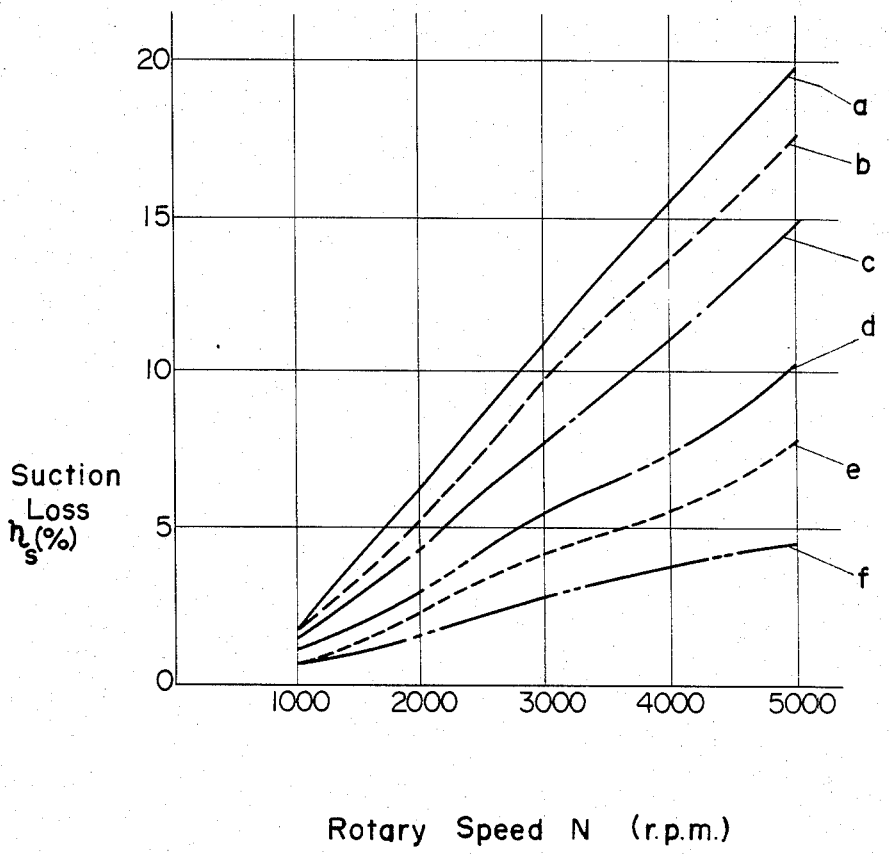
FIG. 17 is a graph showing the suction loss as a function of the rate of rotation of the rotor.
Figure 18:
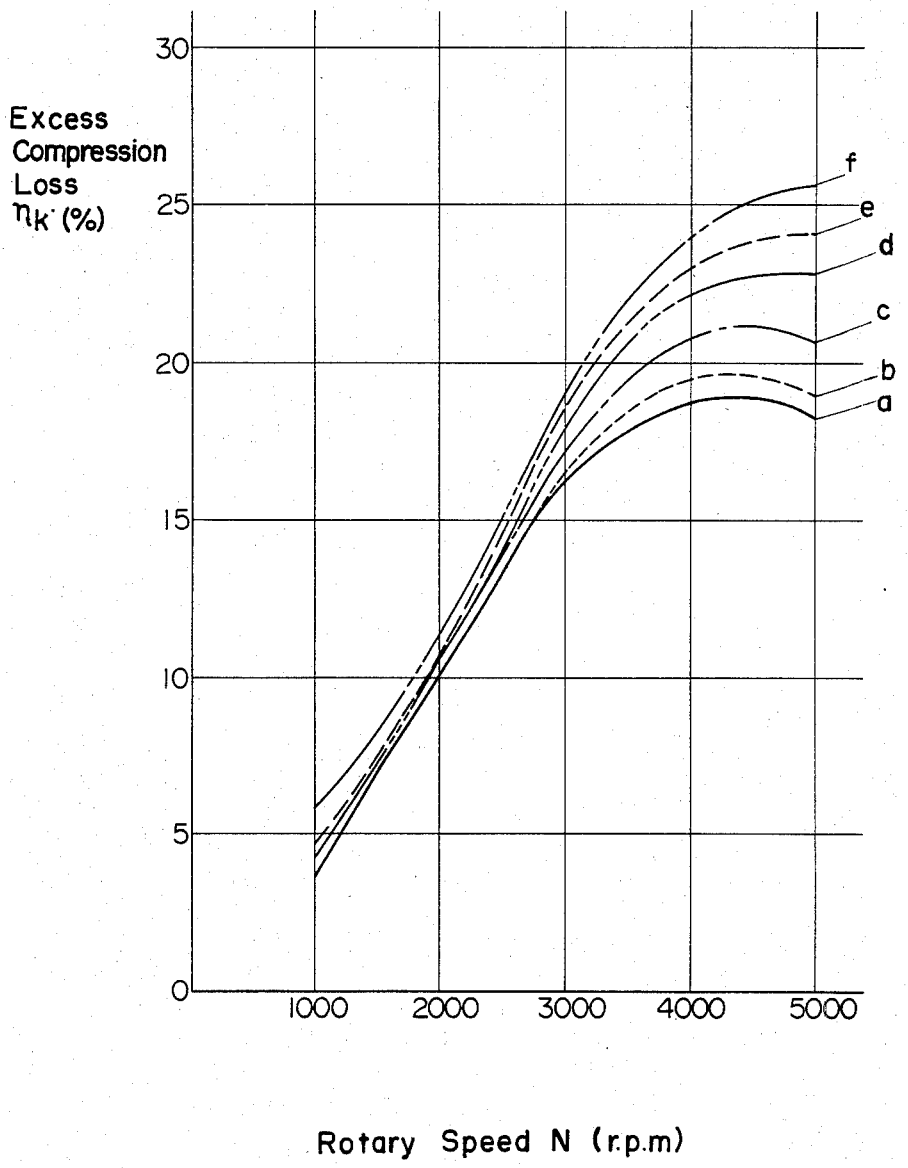
FIG. 18 is a graph showing the excessive compression loss as a function of the rate of rotation of the rotor.

FIGS. 17 and 18 respectively show the suction loss and excessive compression loss for the respective patterns of effective suction area (a) to (f) with respect to the rate of rotation, from which it is seen that the smaller the effective suction area during the suction stroke is, the larger the suction loss becomes, and reversely the larger the excessive compression loss becomes.

As seen from the above result, the effective suction area is made stepped to enable the rotor to rotate at low torque and low speed keeping moderate the capacity control effect. The stepped construction of effective suction area, as abovementioned, is difficult for the three vane to perform, whereby the embodiment of five vanes is the best.

Also, the embodiments of four and five vanes are advantageous because the advantage of the increase in number of vanes outweighs the disadvantage of increased mechanical sliding loss between the vanes and the cylinder.

Now, volume Va of the blade chamber is a function of rotor diameter Rr or the cylinder configuration or the like, so that a method will be proposed which uses the following approximate functions to solve the equations (3) and (4) to provide proper correlation between the respective parameters and the capacity control effect.

The maximum suction volume of refrigerant is represented by Vo and $\psi=\Omega t=(\pi\omega/\theta_s)t$ is used to convert an angle $\theta$ to $\psi$ at which time $\psi$ varies from 0 to $\pi$ and $f(O)=0$ and $f'(O)=0$ at $t=0$ are obtained. Also, the approximate function $f(\pi)$ whereby $f(\pi)=1$ and $f'(\pi)=0$ when the suction stroke terminates at $t=\theta_s/\omega$, is defined.

At this time, volume Va is given by $$Va(\pi)\approx Vo\cdot f(\psi) \quad (6).$$

For example, given $$f(\psi)=\tfrac{1}{2}\cdot(1-\cos t) \quad (7)$$

and $\eta=Pa/Ps$, $$G=\frac{Ps\Omega Vo}{RT_A}\left\{f'(\psi)\cdot\eta+\frac{f(\psi)}{k}\cdot\frac{d\eta}{d\psi}\right\} \quad (8)$$

follows. The equation (4) may be rewritten as $$G=a\sqrt{Ps\cdot\gamma_A\cdot 2g\cdot\frac{k}{k-1}\left[\eta^{\frac{2}{k}}-\eta^{\frac{k+1}{k}}\right]} \quad (9)$$

Accordingly, from the equations (8) and (9), $$K_1\cdot g(\eta)=f'(\psi)\cdot\eta+\frac{f(\psi)}{k}\ \frac{d\eta}{d\psi} \quad (10)$$

and $$g(\eta)=\sqrt{\frac{k}{k-1}\left(\eta^{\frac{2}{k}}-\eta^{\frac{k+1}{k}}\right)} \quad (11)$$

are obtained, where $K_1$ is defined as the dimensionless quantity as follows:

$$K_1=\frac{a\theta s}{Vo\pi\omega}\ \sqrt{2gRT_A}\ . \quad (12)$$

In a case of a sliding vane type compressor, when Vth is assumed to be a theoretical discharge amount, n the number of vanes, and m the number of lobes, normally $Vth=n\times m\times Vo$ is substituted in the equation (12), thus obtaining $$K_1=\frac{a\theta snm}{Vth\pi\omega}\ \sqrt{2gRT_A} \quad (13)$$

In addition, the ratio of specific heat in the equation (10) is a constant depending only on the kind of refrigerant.

In the equation (13), the effective suction area a is a function of vane travelling angle $\psi$ which is a dimensionless quantity, whereby the parameter $K_1$ also becomes a function of $\psi$.

Hence, the solution $\eta=\eta(\psi)$ of equation (10) is determined by a value of $K_1(\psi)$.

R and $T_A$ in the equation (13) are set not by the construction of the compressor, but under the same conditions, whereby the capacity control parameter can be re-defined as follows:

$$K_2(\psi)=a(\psi)\theta s/Vo \quad (14)$$

In other words, the characteristic of pressure in the blade chamber during the suction stroke is seen to be decided principally by the above $K_2(\psi)$. Here, $K_{21}$ and $K_{22}$ are defined as follows by use of the effective suction areas $a_1$ and $a_2$ in the first half of suction stroke and in the second half of the same, respectively:

$$K_{21}=\frac{a_1\cdot\theta_s}{Vo} \quad (15)$$

$$K_{22}=\frac{a_2\cdot\theta_s}{Vo}\ . \quad (16)$$

After examination of FIGS. 9 and 13, the following matters are known. When the effective area in the first half of the suction stroke is substantially changed, the pressure loss $\eta p$ during the high speed driving is changed substantially, but not so much the pressure loss during the low speed driving. For example, $\eta p$, when N=2000 rpm, can be made constant (when a, varies) only by compensating to a minimum ($0.0386<K_{22}<0.0436$) the effective area $a_2$ (or $K_{22}$) in the second half of the suction stroke.

Figure 19:
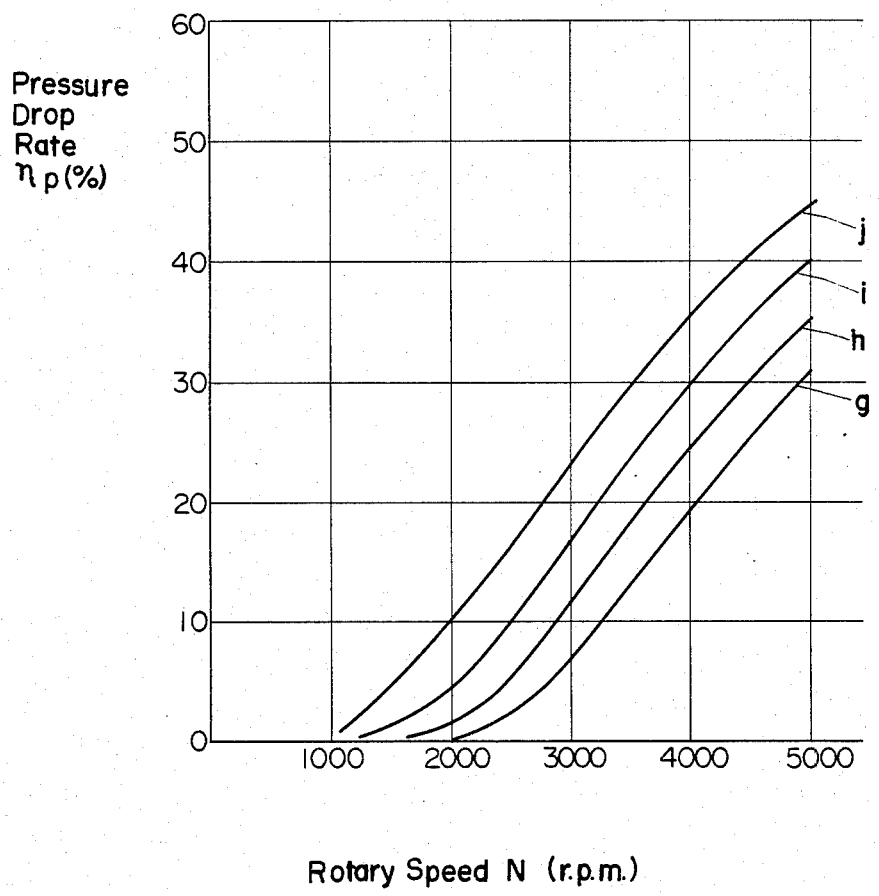
FIG. 19 is a graph showing the rate of pressure drop as a function of the rate of rotation of the rotor for different values of area in the second half of the suction stroke.

Next, in order to define how the pressure drop rate $\eta p$ changes with respect to the rate of rotation $\omega$ when the effective suction area in the second half of suction the stroke is changed, analysis will be given of the following cases. FIG. 19 shows the characteristics of $\eta p$ with respect to N when the effective suction area $a_2$ (i.e. $K_{22}$) in the second half of suction stroke is changed under the respective conditions in Table 4 while keeping constant ($K_{21}=0.060$) the effective suction area in the first half of the suction stroke.

TABLE 4

| | $K_{22}$ |
|---|---|
| (g) | 0.030 |
| (h) | 0.040 |
| (i) | 0.050 |
| (j) | 0.060 |

Figure 20:
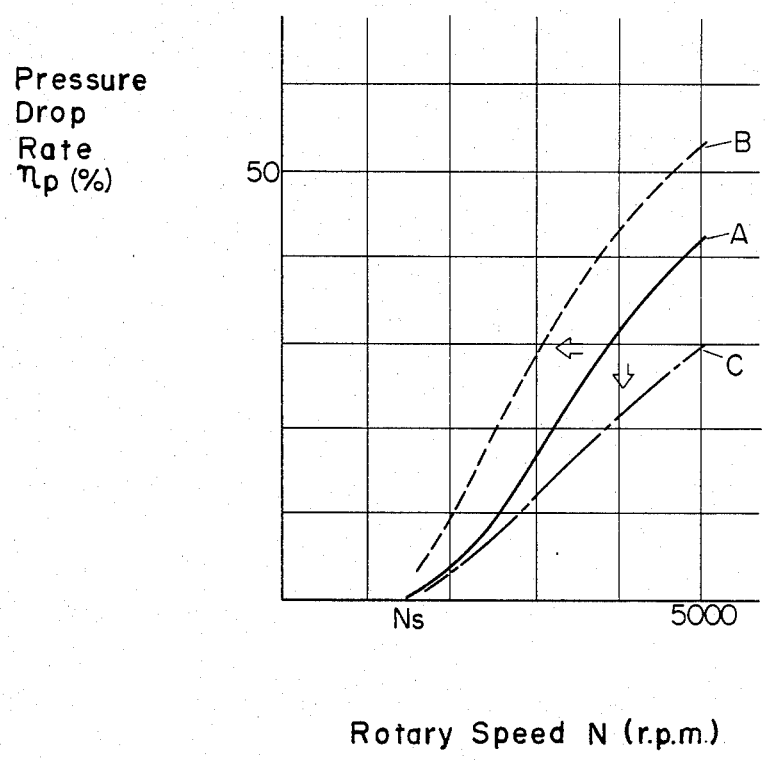
FIG. 20 is a model graph of rate of pressure drop as a function of the rate of rotation of the rotor.

The above results are summarized by use of FIG. 20 illustrating model characteristics as follows:

1. When $K_{21}$ is changed, the slope of $\eta p$ with respect to the rate of rotation N changes as A→C.
2. When $K_{22}$ is changed, the curve of $\eta p$ with respect to N moves in parallel as A→B.

From the above, the parameter $K_{21}$ for the effective area in the first half of the suction stroke is greater than the parameter $K_{22}$ in the second half and is included between (a) and (f) in a practical range as $$K_{22}<K_{21}<0.140 \quad (17).$$

When the effective suction area a is constant during the suction stroke, the parameter $K_1(\psi)$ obtained from the equation (13) becomes constant. When the effective suction area is constant, the following parameter $K_2$ is re-defined:

$$K_2 = \frac{a\theta_s}{Vo}. \quad (18)$$

Figure 21:
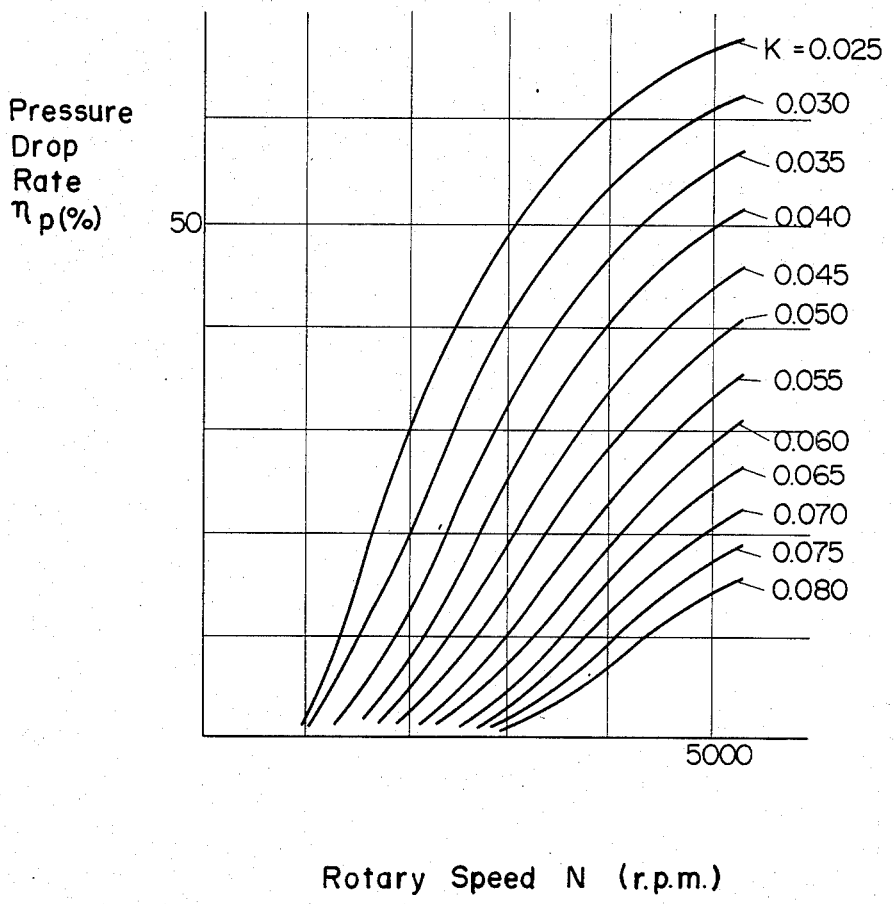
FIG. 21 is a graph showing the rate of pressure drop as a function of the rate of rotation of the rotor when the effective suction area is constant.

In a case where the effective suction area during the suction stroke is constant, $\Delta T = 10$ deg. is assumed as superheat and under the condition of $T_A = 283°$ K. the equations (3) and (4) are solved so that the results therefrom have been arranged by the parameter $K_2$ and shown in FIG. 21.

As is apparent from comparison of FIG. 19 with FIG. 21, for the curve of $K_{22}$ equal to $K_2$, despite the fact that the parameter $K_{21}$ in the first half of suction stroke is different from $K_2$, the values of rate of rotation for $\eta p \simeq 0$ are almost equal to each other. In brief, it is known that the rate of rotation. Ns at the start of capacity control is almost decided by the effective area $a_2$ (parameter $K_{22}$) regardless of the effective area $a_1$ (parameter $K_{21}$) in the first half (regarding Ns, see the model graph of FIG. 20).

Now, the rate of rotation of the car engine during idling is normally set to $N_1 = 800$ to 1000 rpm.

Also, the rate of rotation of the same when the car is running at the speed of $u = 40$ km/h, is $N_2 = 1800$ to 2200 rpm.

After conducting research into the application of the embodiment of the invention to usual cars, it was determined to be most desirable to set the starting point of capacity control in a range of $N_1 < N_s < N_2$.

From FIG. 21, a range of parameter $K_{22}$ is given in the following inequality:

$$0.025 < K_{22} < 0.055 \quad (19).$$

The effective suction areas $a_1$ and $a_2$ for use in computation of the equations (15) and (16) need only be the respective average values.

In addition, the effective suction area is obtained from the product of the sectional area which depends on the geometric configuration of the suction passage, and the coefficient of contraction.

As seen from the above, the embodiment of the compressor of the invention could be constructed to simultaneously satisfy the equations (17) and (19) and sufficiently provide the capacity control in low torque operation during low speed driving and also even during high speed driving.

(III) A Modified Embodiment of the Invention

Figure 22:
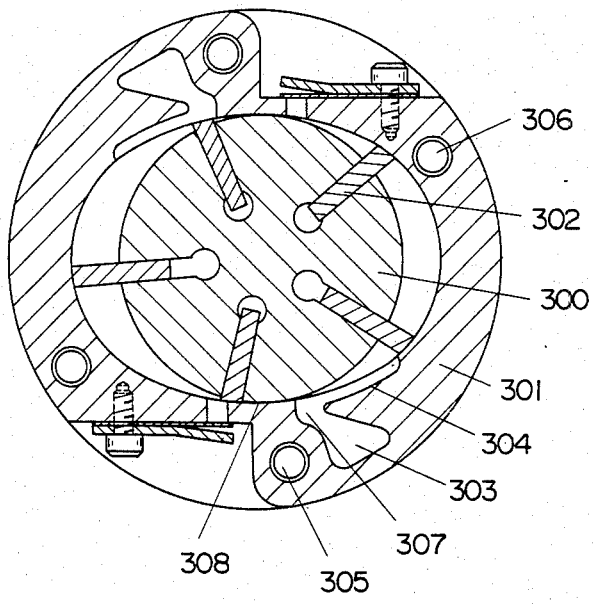
FIG. 22 is a sectional view of a modified embodiment of the invention.

A modified embodiment of the invention is shown in FIG. 22, in which reference numeral 300 designates a rotor, reference numeral 301 designates a cylinder, reference numeral 302 designates vanes, reference numeral 303 designates suction bores, reference numeral 304 designates suction grooves, reference numeral 305 designates set screws at the suction side, reference numeral 306 designates set screws at the discharge side, and reference numeral 307 designates suction nozzles.

In the FIG. 22 construction, the set screws 305 at the suction side for fixing the front plate, rear plate (both are not shown) and cylinder 301, each were provided between the suction bore 303 and the top portion 308 of cylinder, where each suction nozzle 307 was positioned at the center in proximity to the top portion 308 in order to sufficiently enlarge the travelling angle $\theta$ (see Table 1) of cylinder grooves 304.

As seen from the above, the construction of a multilobe type compressor having the effective suction area applied with the stepped change has been proposed. It is effective for limiting leakage of high temperature refrigerant from the high pressure side between the vane and cylinder into the blade chamber during the suction stroke to enlarge the effective suction area in the first half so as to increase the rate of flow of low temperature refrigerant into the blade chamber from the suction port, thereby largely contributing to an improvement in the volumetric efficiency during low speed driving when leakage per unit time is greatest.

INDUSTRIAL APPLICABILITY

As seen from the above, the present invention is summarized as to its effect as follows:

1. Less refrigerating capacity loss at low speed rotation (1000 to 2000 rpm).
2. Large suppression effect on the refrigerating capacity obtained at high speed rotation (3500 to 5000 rpm).
3. Low torque drive especially during the low speed rotation.

The above items 1 to 3 are realizable by the present invention.

What is claimed is:

1. A rotary compressor comprising:

a cylinder having a non-circular inner peripheral surface;

side plates fixed to and closing the axial ends of said cylinder;

a rotor, rotatably mounted in said cylinder, having radially extending, equiangularly spaced slots therein; and slidable vanes radially slidably mounted in said slots so as to slidably engage said inner surface when rotated with said rotor in a rotational direction in said cylinder, so as to define sealing spaces between the outer periphery of said rotor, said inner peripheral surface of said cylinder, and said side plates, and blade chambers in said sealing spaces respectively bounded on at least one circumferential side by said vanes so as to rotate and vary in volume as said rotor and vanes rotate in said cylinder, said blade chambers having a predetermined maximum value $V_0$ during said rotation;

said cylinder having suction bores and discharge bores, including a respective suction port and a respective discharge port opening into each of said sealing spaces through said cylinder adjacent respective opposite circumferential ends thereof, said respective discharge port being located downstream of said respective suction port with respect to the rotational direction of said rotor;

said vanes and said blade chambers rotating across said suction bores and discharge bores as they rotate with said rotor, such that each of said suction bores open into said blade chambers as said blade chambers rotate thereacross, and said suction bores communicate with any one of said blade chambers over a continuous total rotational angle of travel $\theta_s$ of said rotor divided into a first angle of travel $\theta_A$ and a second angle of travel $\theta_1$, such that over said first angle of travel $\theta_A$, said suction bore has a first effective suction area $a_1$ of communication with said blade chamber and, over said second angle of travel $\theta_1$, said suction bore has a second effective suction area $a_2$ of communication with said blade chamber, wherein:

$a_1 > a_2$, $\theta_1/\theta_s > 0.170$ and $0.025 < K_{22} < 0.055$, wherein $K_{22}$ is defined as $a_2\,\theta_s/V_0$.

* * * * *